US010808421B2

(12) United States Patent
Clifford et al.

(10) Patent No.: US 10,808,421 B2
(45) Date of Patent: Oct. 20, 2020

(54) LOCKDOWN CYLINDER LOCKS

(71) Applicant: Schlage Lock Company LLC, Carmel, IN (US)

(72) Inventors: Jason Curtis Clifford, Colorado Springs, CO (US); Scott Douglas Welsby, Colorado Springs, CO (US); Brian Andrew Rappl, St. Louis Park, MN (US); Brian Edward Walls, Colorado Springs, CO (US); Peter Malenkovic, Monument, CO (US); Kenton Hayes Barker, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/434,681

(22) Filed: Jun. 7, 2019

(65) Prior Publication Data

US 2020/0024865 A1 Jan. 23, 2020

Related U.S. Application Data

(62) Division of application No. 14/176,037, filed on Feb. 7, 2014, now abandoned.

(Continued)

(51) Int. Cl.
*E05B 19/00* (2006.01)
*E05B 27/00* (2006.01)

(Continued)

(52) U.S. Cl.
CPC ..... *E05B 19/0029* (2013.01); *E05B 15/0093* (2013.01); *E05B 27/0021* (2013.01);

(Continued)

(58) Field of Classification Search
CPC ..... E05B 19/0029; E05B 15/0093; E05B 27/0046; E05B 27/0042; E05B 29/0066;

(Continued)

(56) References Cited

U.S. PATENT DOCUMENTS 108,099 A 10/1870 Brady
419,091 A 1/1890 Williams (Continued)

FOREIGN PATENT DOCUMENTS

DE 3503660 A1 8/1986
EP 0811737 A2 * 12/1997
WO WO 01/14667 A1 * 3/2001

OTHER PUBLICATIONS

International Search Report, International Searching Authority, International Patent Application No. PCT/US2014/015435, dated May 30, 2014, 2 pages.

(Continued)

*Primary Examiner* — Lloyd A Gall
(74) *Attorney, Agent, or Firm* — Taft Stettinius & Hollister LLP

(57) ABSTRACT

An exemplary lock cylinder includes a shell, a plug positioned in the shell, and a locking assembly. The locking assembly is configured to prevent rotation of the plug when no key is inserted, and to permit rotation of the plug upon insertion of any of a plurality of keys having different bitting profiles. The locking assembly may further be configured to prevent key extraction when the plug is in a rotated position.

20 Claims, 10 Drawing Sheets

Related U.S. Application Data

(60) Provisional application No. 61/761,800, filed on Feb. 7, 2013, provisional application No. 61/761,782, filed on Feb. 7, 2013, provisional application No. 61/761,832, filed on Feb. 7, 2013, provisional application No. 61/761,764, filed on Feb. 7, 2013.

(51) Int. Cl.
*E05B 29/00* (2006.01)
*E05B 15/00* (2006.01)

(52) U.S. Cl.
CPC ..... *E05B 27/0042* (2013.01); *E05B 27/0046* (2013.01); *E05B 27/0053* (2013.01); *E05B 27/0082* (2013.01); *E05B 29/0066* (2013.01); *Y10T 70/7486* (2015.04); *Y10T 70/7588* (2015.04)

(58) Field of Classification Search
CPC ..... E05B 27/0053; E05B 27/0021; E05B 27/0082; Y10T 70/7486; Y10T 70/7588
USPC ..... 70/491–496, 365, 366, 376–378, 392
See application file for complete search history.

(56) References Cited

U.S. PATENT DOCUMENTS 723,539 A 3/1903 Marr
1,041,388 A * 10/1912 Wegmann ..... E05B 59/00 70/107
1,360,622 A 11/1920 Crouch
1,440,459 A 1/1923 Greff
1,514,922 A 11/1924 Olivero
1,564,883 A 12/1925 Muzzio
1,567,979 A 12/1925 Northrop
1,594,033 A 7/1926 Anakin
1,594,297 A 7/1926 Muzzio
1,828,747 A 10/1931 Perry
1,832,498 A 11/1931 Muzzio
1,883,326 A 10/1932 Thor
1,886,822 A 11/1932 Main
1,896,523 A 2/1933 Main
1,965,336 A * 7/1934 Fitz ..... E05B 29/00 70/495
1,979,805 A 11/1934 Main
2,003,086 A * 5/1935 Liss ..... E05B 27/0082 70/495
2,024,441 A * 12/1935 Fitz ..... E05B 29/00 70/495
2,061,354 A 11/1936 Federholzner
2,070,233 A * 2/1937 Liss ..... E05B 27/0082 70/495
2,405,911 A * 8/1946 Swanson ..... E05B 29/00 70/495
2,528,964 A 11/1950 Lurtz
2,629,247 A * 2/1953 Deutsch ..... E05B 29/004 70/340
2,660,876 A * 12/1953 Spain ..... E05B 29/0066 70/495
3,404,548 A 10/1968 Keefer
3,418,833 A 12/1968 Kerr
3,475,933 A 11/1969 Kobrehel
3,499,302 A * 3/1970 Flora ..... E05B 27/0039 70/494
3,505,842 A 4/1970 Taylor
3,599,455 A 8/1971 Pilvet
3,620,056 A 11/1971 Weber, Jr.
3,713,311 A 1/1973 Oliver et al.
3,722,240 A * 3/1973 Spain ..... E05B 27/0039 70/494
3,759,074 A 9/1973 Prahl
3,988,911 A 11/1976 Lipschutz
3,999,413 A * 12/1976 Raymond ..... E05B 29/004 70/495
4,026,133 A 5/1977 Marter
4,073,171 A 2/1978 Moorhouse
4,075,879 A 2/1978 Christopher
4,196,606 A 4/1980 Guiraud
4,254,648 A * 3/1981 Dietrich ..... E05B 11/00 70/380
4,275,577 A 6/1981 Castaldo
4,300,374 A 11/1981 Mullich et al.
4,326,396 A 4/1982 Steinbach
4,356,713 A 11/1982 Widen
4,369,642 A 1/1983 Grell
4,391,112 A 7/1983 Neyret et al.
4,393,673 A 7/1983 Widen
4,620,430 A 11/1986 Latone
4,723,427 A 2/1988 Oliver
4,750,342 A * 6/1988 Nakai ..... E05B 29/00 70/377
4,841,758 A 6/1989 Ramblier
4,875,352 A 10/1989 Smallegan
4,893,488 A 1/1990 Klein
4,941,336 A 7/1990 Steckler
4,953,420 A 9/1990 Krubsack et al.
5,189,895 A 3/1993 Schwab et al.
5,293,764 A 3/1994 Guzzinati
5,419,168 A * 5/1995 Field ..... E05B 27/0039 70/494
5,479,800 A 1/1996 Myers
5,517,840 A 5/1996 Haggstrom
5,570,601 A 11/1996 Field
5,582,050 A 12/1996 Haggstrom
5,666,835 A 9/1997 Keller
5,678,437 A 10/1997 Walla
5,934,124 A 8/1999 Yasuhara
5,943,890 A 8/1999 Field et al.
5,964,110 A 10/1999 Crocco et al.
5,964,111 A 10/1999 Lambert
6,481,255 B2 11/2002 Theriault et al.
6,516,644 B1 2/2003 Seliber
6,526,791 B2 3/2003 Shvarts
7,100,409 B2 9/2006 Chang
7,165,427 B1 1/2007 Lai
7,377,146 B2 5/2008 Field et al.
7,574,883 B2 8/2009 Grampurohit
7,640,773 B2 1/2010 Bellamy et al.
7,775,074 B1 8/2010 Tobias et al.
7,878,036 B2 * 2/2011 Armstrong ..... E05B 27/0082 70/492
7,900,491 B2 * 3/2011 Chong ..... E05B 27/005 70/492
7,963,135 B1 6/2011 Tobias et al.
7,966,852 B1 6/2011 Huang
8,720,241 B1 * 5/2014 Widen ..... E05B 19/0023 70/495
9,435,138 B2 * 9/2016 Walls ..... E05B 27/0017
9,512,638 B2 * 12/2016 Clifford ..... E05B 11/00
9,598,880 B2 * 3/2017 Walls ..... E05B 27/0017
2004/0172995 A1 * 9/2004 Haggstrom ..... E05B 27/0007 70/495
2005/0172688 A1 * 8/2005 Widen ..... E05B 27/0082 70/495
2006/0016232 A1 1/2006 Hung
2009/0301144 A1 * 12/2009 Herman ..... E05B 27/0053 70/1
2012/0073340 A1 * 3/2012 Widen ..... E05B 27/0017 70/495
2012/0304717 A1 * 12/2012 Loreti ..... E05B 29/004 70/493
2017/0306649 A1 * 10/2017 Baumhauer ..... E05B 29/0066
2019/0257115 A1 * 8/2019 Clifford ..... E05B 9/086

OTHER PUBLICATIONS

Written Opinion of the International Searching Authority, International Patent Application No. PCT/US2014/015435, dated May 30, 2014, 5 pages.

* cited by examiner

LOCKDOWN CYLINDER LOCKS

CROSS REFERENCE TO RELATED APPLICATIONS

The present application is a divisional of U.S. patent application Ser. No. 14/176,037 filed Feb. 7, 2014, now abandoned, which claims the benefit of U.S. Provisional Patent Application No. 61/761,764, U.S. Provisional Patent Application No. 61/761,782, U.S. Provisional Patent Application No. 61/761,800, and U.S. Provisional Patent Application No. 61/761,832, each filed on Feb. 7, 2013, the contents of each application are incorporated herein by reference in their entirety.

TECHNICAL FIELD

The present invention generally relates to locks, and more particularly, but not exclusively, to lockdown-type cylinder locks.

BACKGROUND

In certain settings such as schools, it is often desirable that doors have the ability to be locked in emergency situations or lockdowns by any faculty or staff member. While certain conventional systems employ a thumb-turn or a similar apparatus on the interior side of the door, it may be desirable to permit only certain individuals to lock and unlock the door. It may also be desirable that the lock be able to perform basic functions such as securing the door and retaining the key within the plug while the lock is being operated. Currently, there is not believed to be a lock operable by any key regardless of the bitting profile or top cut. There is a need for the unique and inventive locking apparatuses, systems and methods disclosed herein.

SUMMARY

An exemplary lock cylinder includes a shell, a plug positioned in the shell, and a locking assembly. The locking assembly is configured to prevent rotation of the plug when no key is inserted, and to permit rotation of the plug upon insertion of any of a plurality of keys having different bitting profiles. The locking assembly may further be configured to prevent key extraction when the plug is in a rotated position. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
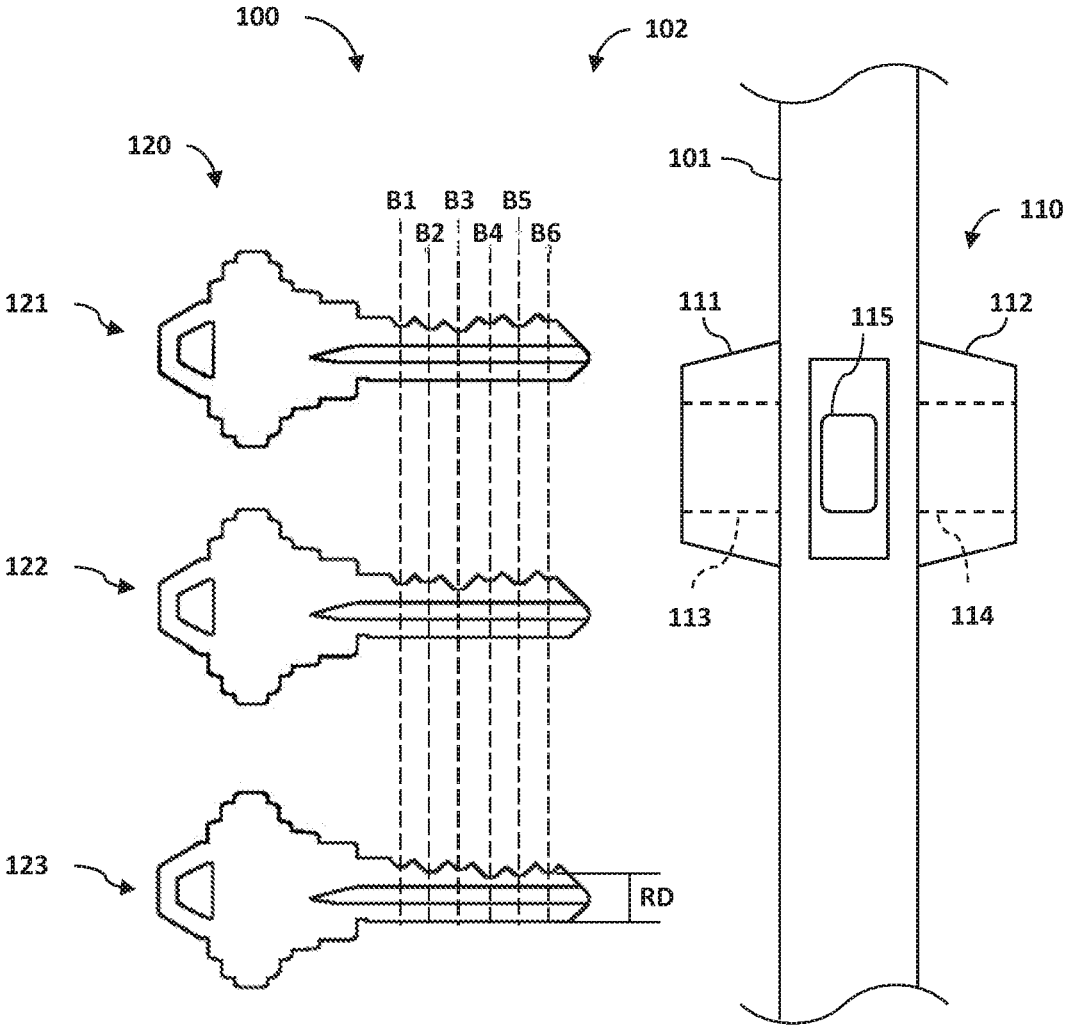
FIG. 1 depicts an access control system according to an embodiment of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, an illustrative access control system 100 is configured to selectively permit access via a door 101 to an access-controlled room or space 102. The access control system 100 includes a lock system 110 mounted on the door 101, and a key family 120 including a plurality of keys 121-123 having different key cuts.

The lock system 110 includes an inner core housing 111 mounted on the secured or interior side of the door 101, and an outer core housing 112 mounted on the unsecured or exterior side of the door 101. A lock cylinder 113 according to an embodiment of the invention is installed in the inner core housing 111, and a second lock cylinder 114 is installed in the outer core housing 112. As described in further detail below, the lock cylinder 113 is a lockdown type lock cylinder operable by each member of the key family 120. The second lock cylinder 114 may be a conventional lock cylinder operable by only a subset of the key family 120. A bolt 115 is operationally coupled to each of the lock cylinders 113, 114, and can be moved between an extended locking position and a retracted unlocking position by operation of either of the cylinders 113, 114.

As is common with cylinder locks, the lock cylinders 113, 114 each include a shell and a selectively rotatable plug (not illustrated). The lock cylinders 113, 114 are configured to transition the lock system 110 between a locked state and an unlocked state upon rotation of the plug. During the rotation, the plug may engage an armature (not illustrated), which in turn may extend or retract the bolt 115. Rotation in a first direction may serve to extend the bolt 115 toward a locking position, while rotation in a second direction may serve to retract the bolt 115 toward an unlocking position. Each cylinder 113, 114 is operable in an unblocked state wherein rotation of the plug is permitted, and a blocked state wherein rotation of the plug is prevented.

The key family 120 includes a plurality of keys 121-123 comprising different key cuts; the key cut includes a cross-sectional profile or side cut and a bitting profile or top cut. The cross-sectional profiles are such that each of the keys 121-123 can be inserted into the keyway of at least the inner cylinder 113. The cross-sectional profile may correspond to the geometry of the keyway of the inner cylinder 113, and may be uniform throughout the key family 120. Alternatively, the cross-sectional profile of one or more of the keys 121-123 may be different than that of another of the keys 121-123, so long as each member of the key family 120 can be inserted into the plug of the inner cylinder 113. Further details regarding exemplary cross-sectional profiles are described below with reference to FIG. 10.

The bitting profile or top cut may vary from key to key in the key family 120, and is defined by the root depth RD of the key at each of the bitting positions B1-B6. The root depth RD at each of the bitting positions B1-B6 is selected from a predetermined set of possible root depths. In certain embodiments, the set of possible root depths may be calculated using an equation such as $RD=RD_{max}-\delta \cdot n$, where $RD_{max}$ is a maximum root depth, δ is an incremental distance, and n is an integer ranging from zero to a predetermined maximum. By way of non-limiting example, if $RD_{max}$ is selected as 0.335 inches, δ is selected as 0.015 inches, and the predetermined maximum is selected as nine, the set of possible root depths includes ten possible root depths ranging from a minimum possible root depth of 0.200 inches to a maximum possible root depth of 0.335 inches. In certain embodiments, the set of possible root depths may allow for slight deviations from the nominal possible root depths to account for tolerances. In such embodiments, one or more of the maximum possible root depth and the minimum possible root depth may vary from their nominal values by a tolerance factor.

Once the set of possible root depths has been determined, a bitting profile for each of the keys 121-123 can be selected from a set of available bitting profiles, each of which is defined at least in part by a unique combination of root depths at the various bitting positions B1-B6. The number of available bitting profiles depends upon the number of bitting positions and the number of possible root depths. In the present example, the key family 120 includes six bitting positions B1-B6, each of which can have any of the ten possible root depths. As such, there are $10^6$ unique bitting profiles available to the key family 120, each of which may be represented as a bitting code comprising a series of integers indicating the value of n at each of the bitting positions B1-B6. It is also contemplated that a key family may include more or fewer bitting positions, and more or fewer possible root depths. For example, the key family may include five or more bitting positions and six or more possible root depths; in such a case, there would be at least $5^6$ unique bitting profiles. In further embodiments, the key family may include as few as one bitting position and two possible root depths.

In the illustrated key family 120, each of the keys 121-123 comprises a unique bitting profile. In other words, at least one of the bitting positions of each of the keys 121-123 comprises a root depth which is different than the root depth of another of the keys at the same bitting position. For example, the root depth RD of the first key 121 at the third bitting position B3 is different than the root depths of the other keys 122, 123 at the third bitting position B3.

The inner cylinder 113 is configured to remain in the blocked state when no key is inserted, and to transition to the unblocked state upon insertion of any member of the key family 120. That is to say, each member of the key family 120 can be used to operate the cylinder 113, regardless of the bitting profile of the key. As such, the root depth RD at each of the bitting positions B1-B6 of each of the keys 121-123 can be different than the root depth at the corresponding bitting position of another of the keys. In other words, the entire set of possible root depths is available for each of the bitting positions B1-B6, and each of the possible bitting profiles can be utilized to operate the inner lock cylinder 113. The inner lock cylinder 113 may be configured in a number of ways to provide this functionality; exemplary configurations are described below with reference to FIGS. 2-9.

Because each member of the key family 120 can transition the inner lock cylinder 113 from the blocked state to the unblocked state, any of the keys 121-123 can be used to extend the bolt 115 and lock the door 101 from the inside of the room 102, for example to prevent an intruder from entering. In certain applications, it may also desirable to maintain the door 101 locked with a higher security level when the room 102 is unoccupied, for example to prevent theft or vandalism. As such, the outer lock cylinder 114 may be operable by only one of the keys in the key family 120, or by only a subset of the keys in the key family 120. Due to the fact that the keys 121-123 may comprise any of the possible bitting profiles, a greater number of unique bitting profiles are available to the key family 120, and a corresponding number of unique pinning configurations are available to other locks in the system 100 (such as the outer lock cylinder 114). As a result, each member of the key family 120 can operate the interior lock cylinder 113, and can also be cut to operate standard lock cylinders in locations where higher security is required.

Figure 2:
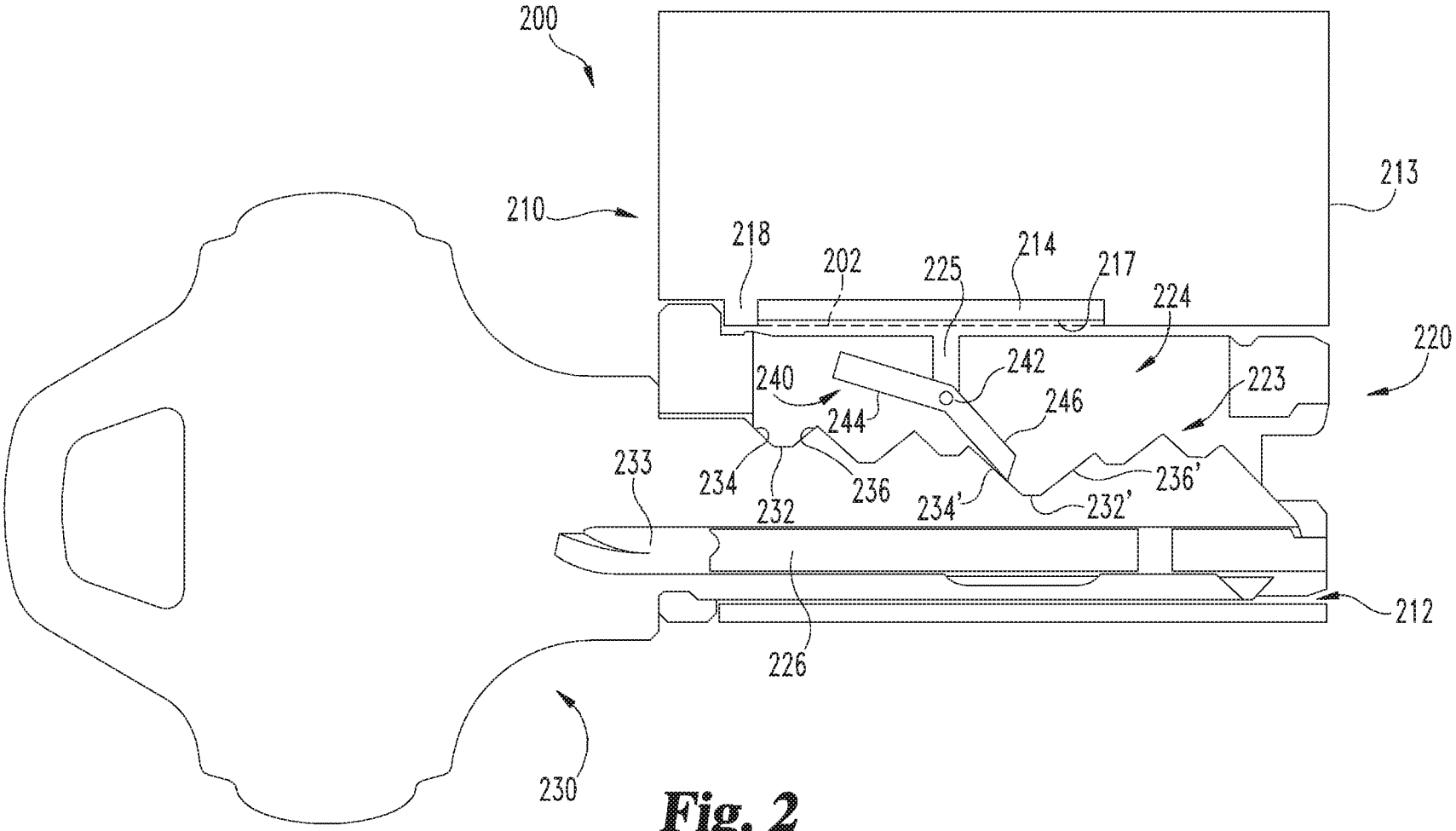
FIG. 2 is a longitudinal cross-sectional illustration of a first exemplary lock cylinder.
Figure 3:
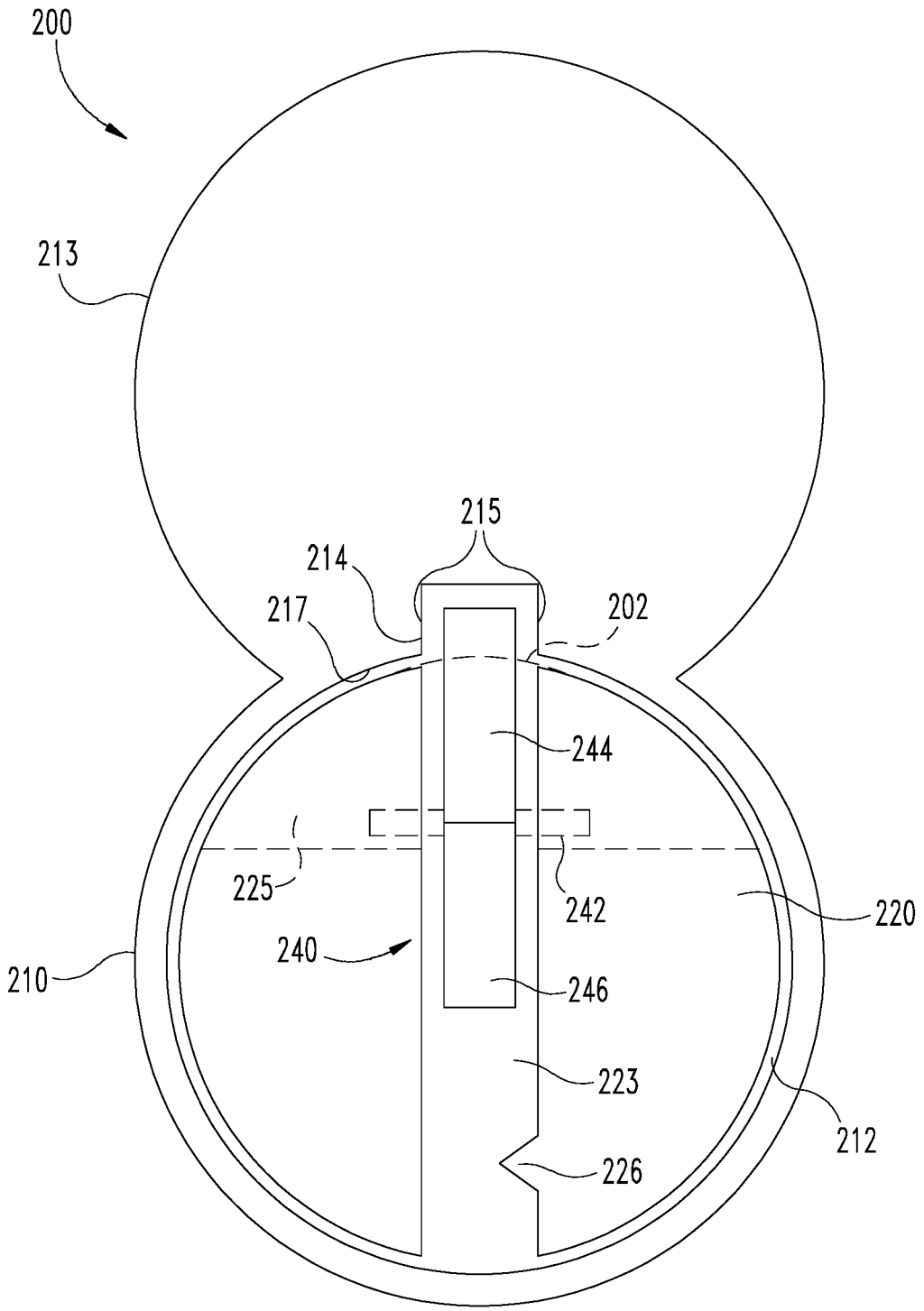
FIG. 3 is a transverse cross-sectional illustration of the first exemplary lock cylinder.

With reference to FIGS. 2 and 3, a first exemplary lock cylinder 200 includes a shell 210, a plug 220 disposed within the shell 210, and a locking assembly operable in a blocking state and an unblocking state, depicted herein as a knock-down pin 240. When the knock-down pin 240 is in the blocking state (FIG. 3), rotation of the plug 220 is prevented, defining a blocked state of the cylinder 200. When the knock-down pin 240 is in the unblocking state (FIG. 2), rotation of the plug 220 is permitted, defining an unblocked state of the cylinder 200. The knock-down pin 240 is configured such that, upon insertion of a proper key 230, the key 230 engages the knock-down pin 240 to transition the knock-down pin 240 from the blocking state to the unblocking state. The cylinder 200 is configured to transition between a locked state and an unlocked state upon rotation of the plug 220; for example, when the plug 220 is rotated, it may engage an armature (not illustrated) to throw a bolt between a locking position and an unlocking position.

The shell 210 includes a generally cylindrical chamber 212 in which the plug 220 is positioned. The shell 210 may further include a tower 213 configured to provide the shell 210 with a geometry corresponding to that of a cylinder housing (not illustrated). In the illustrated embodiment, the configuration of the shell 210 enables the cylinder 200 to be installed in a small format interchangeable core (SFIC) housing. It is also contemplated that the shell 210 may be of another configuration, such that the cylinder 200 is of another format. For example, the shell 210 may be of a standard configuration, such as full size, large format, mortise, rim, or key-in-knob/lever. The shell 210 further includes a channel 214 defined in part by substantially parallel surfaces or walls 215 extending radially outward from an inner surface 217 of the shell 210. The shell 210 may further include a protrusion or ridge 218 configured to prevent insertion of a foreign object into the channel 214.

The plug 220 includes a keyway 223 extending from a proximal or forward end of the plug 220 toward a distal or rearward end of the plug 220. The plug 220 further includes a pocket 224 configured to receive the knock-down pin 240, and a notch 225 for mounting the knock-down pin 240. The plug 220 may further include a ward 226 extending into the keyway 223 to provide the keyway 223 with a non-rectangular cross-section, to prevent insertion of a key which does not include a correspondingly-shaped groove, such as the groove 233 on the key 230. While the illustrated plug 220 includes only a single ward 226, other configurations are contemplated as within the scope of the invention; additional illustrative configurations are described below with reference to FIG. 10. As best seen in FIG. 3, when the plug 220 is in a home position, the pocket 224 is aligned with the channel 214, and a shear line 202 is defined between the pocket 224 and the channel 214.

The key 230 includes a plurality of bittings 232 formed at bitting positions of the key 230, and a groove 233 having a shape corresponding to that of the ward 226. At each of the bitting positions, the key 230 comprises a root depth which is selected from a predetermined set of possible root depths, for example as described above. Each of the bittings 232 includes a proximal bitting surface 234 and a distal bitting surface 236; one of the bittings 232 is an engagement bitting 232' including a proximal engagement surface 234' and a distal engagement surface 236'. In the illustrated embodiment, the engagement bitting 232' is defined at the fourth bitting position of the key 230, although other bitting positions are contemplated. The functions of the engagement bitting 232' and engagement surfaces 234', 236' are described below.

The knock-down pin 240 is positioned at least partially in the pocket 224, and is rotatably mounted to the plug 220. The knock-down pin 240 includes an axle 242, an upper leg 244, and a lower leg 246 offset at an oblique angle with respect to the upper leg 244. The knock-down pin 240 may be fabricated using any number of manufacturing methods, such as, for example, machining, plastic or metal injection molding, die casting, or 3D printing. During assembly of the cylinder 200, the knock-down pin 240 is inserted into the plug 220 such that the axle 242 rests in the notch 225. The plug 220 is then inserted into the shell 210, where it is restrained from axial movement, for example by a threaded end cap or a C-clip (not illustrated).

When the plug 220 is in the home position and the key 230 is not inserted (FIG. 3), the knock-down pin 240 is in the blocking state, and rotation of the plug 220 is prevented. In the blocking state, the upper leg 244 extends across the shear line 202 into the channel 214, and the lower leg 246 extends into the keyway 223 and toward the proximal end of the plug 220. If a user attempts to rotate the plug 220 when the knock-down pin 240 is in the blocking state, the walls 215 block the rotational path of the upper leg 244, preventing rotation of the plug 220. In other words, when the upper leg 244 crosses the shear line 202, the plug 220 is not rotatable with respect to the shell 210, and the cylinder 200 is in the blocked state.

The knock-down pin 240 is biased toward the blocking state, such that, in the absence of external forces such as insertion of the key 230, the cylinder 200 is in the blocked state. In the illustrated embodiment, the configuration of the knock-down pin 240 provides the biasing force: the lower leg 246 is of a greater mass than the upper leg 244, and gravitational forces urge the knock-down pin 240 toward the blocking state. It is also contemplated that the biasing force may be provided in another manner, such as by a torsional spring associated with the axle 242.

When the key 230 is inserted, the lower leg 246 travels along the top cut of the key 230, thus rotating the knock-down pin 240 about the axle 242. When the key 230 is fully inserted (FIG. 2), the lower leg 246 contacts the proximal engagement surface 234', moving the knock-down pin 240 to an unblocking state, wherein the upper leg 244 is positioned in the pocket 224 and does not cross the shear line 202. In the unblocking state, the walls 215 do not block the rotational path of the upper leg 244, and the plug 220 is free to rotate from the home position to a rotated position. In other words, when the upper leg 244 does not cross the shear line 202, the plug 220 is rotatable with respect to the shell 210, and the cylinder 200 is in the unblocked state. Rotation of the plug 220 in a first direction may transition the cylinder 200 to a locked state, and rotation in an opposite direction may transition the cylinder 200 to an unlocked state.

If the user attempts to extract the key 230 when the plug 220 is in the rotated position, the lower leg 246 engages the distal engagement surface 236', urging the knock-down pin 240 toward the unblocking state. Because the pocket 224 is not aligned with the channel 214, however, the upper leg 244 contacts the shell inner surface 217, preventing further rotation of the knock-down pin 240. Thus, the mutual engagement of the knock-down pin 240 with the shell inner surface 217 and the distal engagement surface 236' prevents the key 230 from being removed from the keyway 223 until the plug 220 is returned to the home position.

As with the previously-described inner lock cylinder 113, the lock cylinder 200 is configured to transition from the blocked state to the unblocked state upon insertion of any key from a selected key family, regardless of the key's bitting profile. To ensure that the knock-down pin 240 transitions from the blocking state to the unblocking state upon insertion of the key 230, the offset angle and length of the legs 244, 246 may be selected such that lower leg 244 contacts the proximal engagement surface 234' to rotate the upper leg 244 into the pocket 224, even when the root depth of the key 230 at the contact point is at a minimum. In order to ensure that the knock-down pin 240 prevents the key 230 from being extracted when the plug 220 is in the rotated position, the offset angle and length of the legs 244, 246 may additionally be selected such that lower leg 244 contacts the distal engagement surface 236' and the upper leg 244 contacts the shell inner surface 217, even when the root depth of the key 230 at the contact point is at a minimum or a maximum possible for the key 230.

As can be seen from the foregoing description, the cylinder 200 provides standard features such as key retention, and can be operated by any number of keys, regardless of the top cut of the key. In so doing, the cylinder 200 provides greater security than systems which do not require a key to lock or unlock (such as those employing thumb-turns), but enable operation by a large number of different keys, for example during lockdown situations. The embodiments depicted in FIGS. 4-9 perform similar functions, and may include features which are substantially similar to the embodiment described above with respect to FIGS. 2 and 3. In the following figures, similar reference characters are used to denote similar features; unless stated to the contrary, the descriptions of the illustrated and alternative features of the lock cylinder 200 may be applicable to the corresponding features in the embodiments described hereinafter. In the interest of conciseness, the following descriptions focus primarily on features which are different than those described with respect to the cylinder 200.

Figure 4:
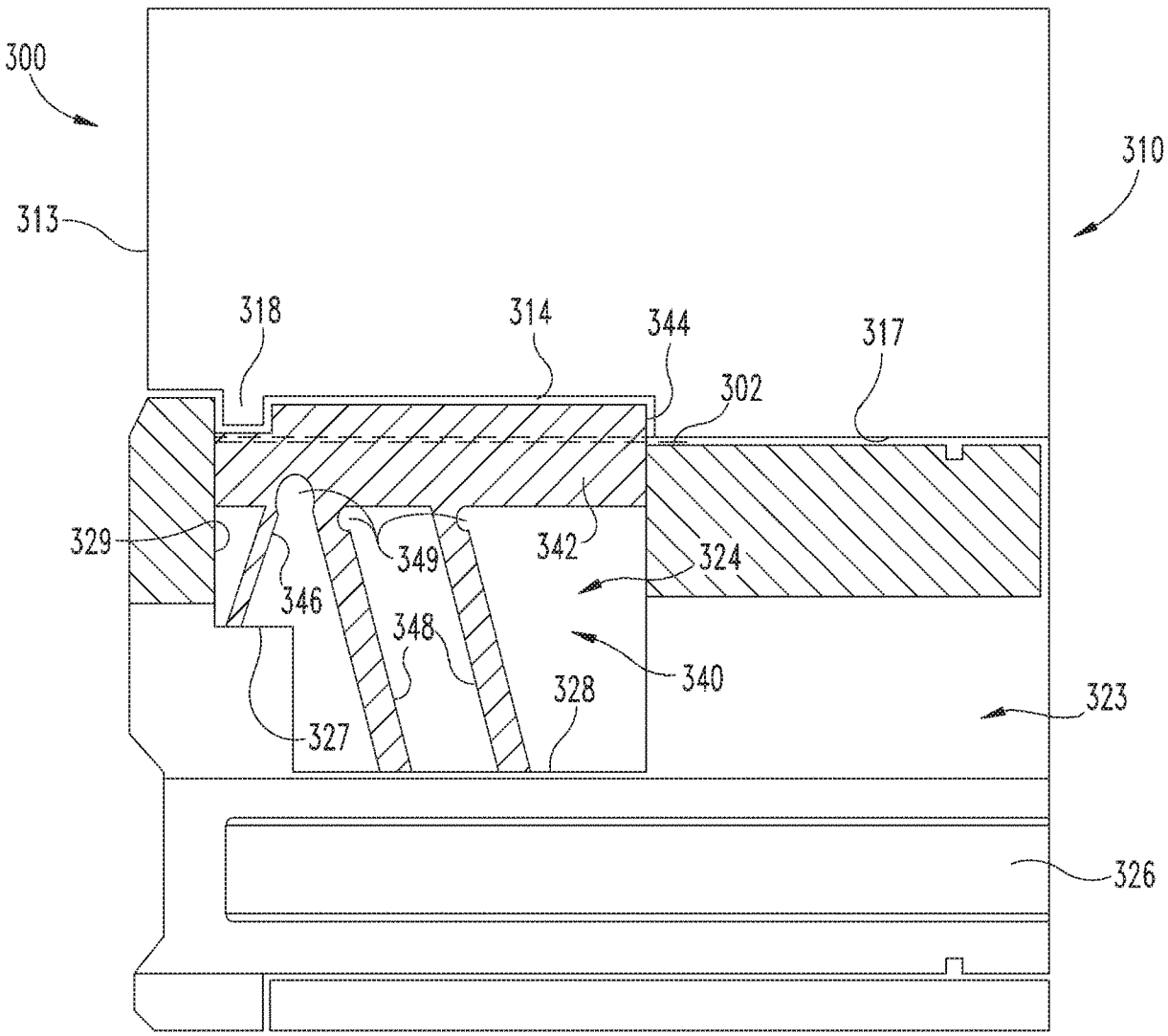
FIG. 4 is a longitudinal cross-sectional illustration of a second exemplary lock cylinder.
Figure 5:
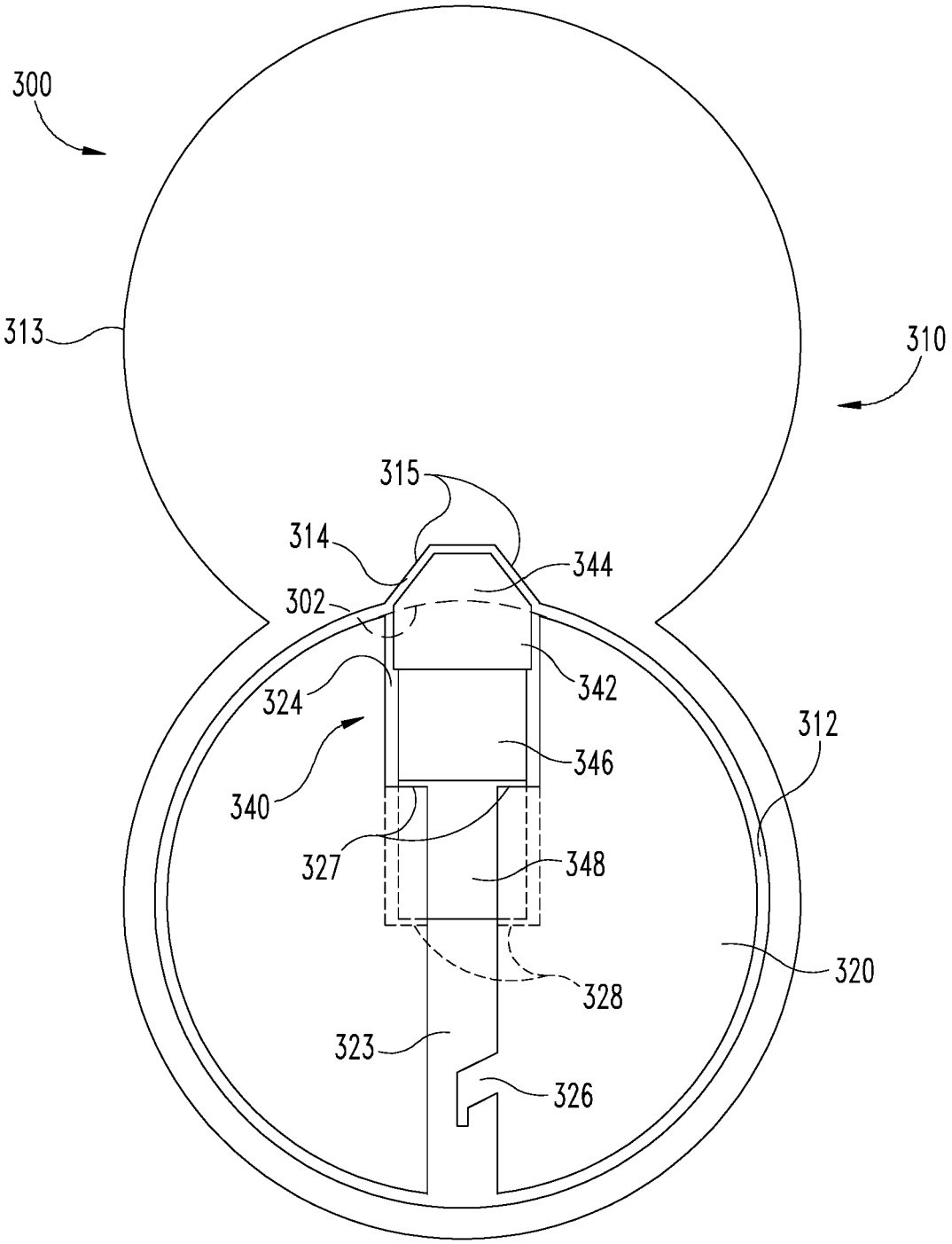
FIG. 5 is a transverse cross-sectional illustration of the second exemplary lock cylinder.

With reference to FIGS. 4 and 5, a second exemplary lock cylinder 300 includes a shell 310, a plug 320 disposed within the shell 310, and a locking assembly operable in a blocking state and an unblocking state, depicted herein as a flexible member 340. The shell 310 comprises a generally cylindrical chamber 312 and a channel 314 including cam surfaces or tapered surfaces 315 which extend radially outward from an inner surface 317 of the shell 310. The plug 320 includes a keyway 323, a pocket 324 configured to receive the flexible member 340, and a plurality of ledges 327, 328 and a wall 329 which define borders of the pocket 324. As best seen in FIG. 4, when the plug 320 is in a home position, the pocket 324 is aligned with the channel 314.

The flexible member 340 includes an elongated body 342, a cam surface or tapered portion 344, a blocking leg 346, and a plurality of engagement legs 348. The tapered portion 344 extends radially outward from a first side of the body 342, and the legs 346, 348 extend radially inward at oblique angles from the opposite side of the body 342. The blocking leg 346 is angled toward the proximal end of the plug 320, and the engagement legs 348 are angled toward the distal end of the plug 320. As described in further detail below, when a key is inserted, the legs 346, 348 elastically deform or pivot toward the distal end of the plug 320; the flexible member 340 may include arcuate cutouts 349 to facilitate such elastic deformation.

When the plug 320 is in the home position no key is inserted, the flexible member 340 is in a blocking state and rotation of the plug 320 is prevented. In the blocking state, the flexible member 340 extends across a shear line 302 of the cylinder 300, the tapered portion 344 is positioned at least partially in the channel 314, and the engagement legs 348 extend into the keyway 323. The blocking leg 346 rests on a first set of ledges 327 and the engagement legs 348 rest on a second set of ledges 328, thereby retaining the flexible member 340 in the blocking state and preventing the flexible member 340 from sliding radially into the plug 320. If a user attempts to rotate the plug 320 when the flexible member 340 is in the blocking state, one of the cam surfaces 315 engages the tapered portion 344, urging the flexible member 340 radially inward. In other words, torque applied to the plug 320 is translated to a radially-inward force due to the engagement of the cam surface 315 and the tapered portion 344. This radially-inward force is transferred to the legs 346, 348, which in turn engage the ledges 327, 328, respectively. In the illustrated embodiment, the channel 314 and the tapered portion 344 each comprise a substantially rectilinear cross-section; it is also contemplated that the channel 314 and/or the tapered portion 344 may comprise a curvilinear crass-section.

As a result of the angular orientation of the blocking leg 346, engagement with the ledge 327 upon rotation of the plug 320 urges the blocking leg 346 toward the proximal end of the plug 320 and into engagement with the wall 329. When the blocking leg 346 engages the wall 329, the blocking leg 346 is no longer free to travel toward the proximal end of the plug 320. In this position, the radially-inward force is opposed by the ledge 327 and the wall 329. This opposing force counters the radially-inward force resulting from engagement of the cam surface 315 and the tapered portion 344, preventing further radially-inward motion of the flexible member 340. Because flexible member 340 cannot move radially inward, interference between the cam surface 315 and the tapered portion 344 prevents further rotation of the plug 320.

When a proper key is inserted, the engagement legs 348 deform or pivot toward the distal end of the plug 320 as the lower surfaces of the legs 348 travel along the bitted top surface of the key. When the key is at least partially inserted, each of the engagement legs 348 is positioned between proximal and distal surfaces of a bitting. When the key is fully inserted, the blocking leg 346 engages a shoulder on the shank near to the bow or head of the key, deforming or pivoting the blocking leg 346 toward the distal end of the plug 320 and out of engagement with the ledge 327. When the blocking leg 346 is no longer engaged with the ledge 327, the flexible member 340 is in an unblocking state. In the unblocking state, the radially-inward force resulting from torque applied to the plug 320 is not opposed by the wall 329 or the ledge 327. As such, radially-inward motion of the flexible member 340 is permitted, enabling rotation of the plug 320 to a rotated position. As the plug 320 rotates from the home position to the rotated position, the flexible member 340 cams radially inward as the tapered portion 344 travels along the cam surface 315 and into contact with the shell inner surface 317.

Like the previously-described cylinder 200, the cylinder 300 of the present embodiment is configured to permit key extraction when the plug 320 is in the home position, and to prevent key extraction when the plug 320 is in the rotated position. When the user attempts to extract the key when the plug 320 is in either the home position or the rotated position, the engagement legs 348 come into contact with the distal bitting surfaces of the key. In order to permit key extraction when the plug 320 is in the home position, the engagement legs 348 are configured to deform when the tapered portion 344 is positioned in the channel 314. In order to prevent key extraction when the plug 320 is in the rotated position, the engagement legs 348 are configured to resist further deformation when the tapered portion 344 is in contact with the shell inner surface 317.

As with the knock-down pin 240, the flexible member 340 is configured to transition from the blocking state to the unblocking state upon insertion of a key, and to prevent key extraction when the plug 320 is in the rotated position, regardless of the bitting profile of the key. These functions may be provided by appropriate selection of one or more of the offset angle of the engagement legs 348, rigidity of the material of which the flexible member 340 is formed, the size and configuration of arcuate cutouts 349, and/or geometry of the tips of the engagement legs 348. For example, the flexible member 340 may be configured in a manner that, when the tapered portion 344 is in contact with the inner surface 317, the engagement legs 348 are substantially perpendicular to the distal bitting surfaces, such that substantially all the force exerted by the distal bitting surface is opposed by forces transmitted through the engagement legs 348.

Figure 6:
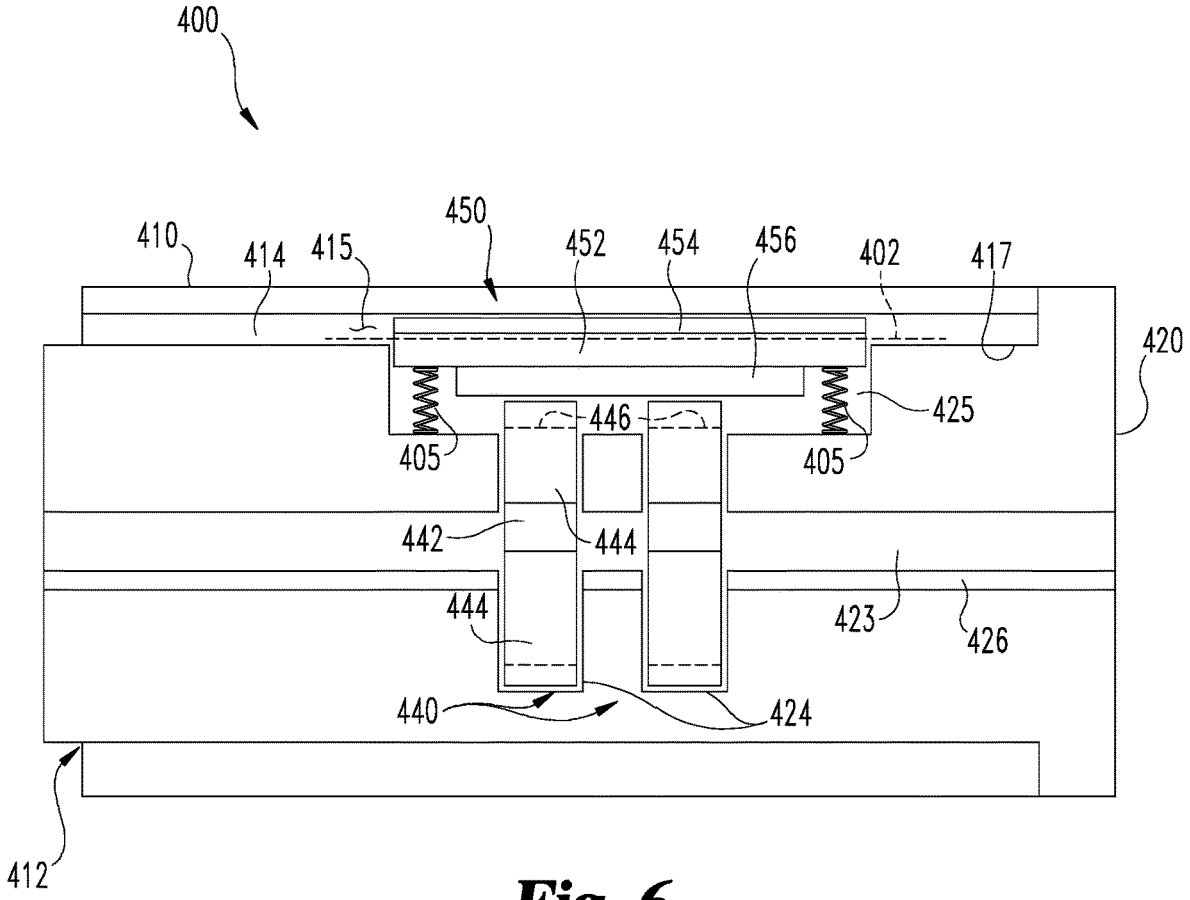
FIG. 6 is a longitudinal cross-sectional illustration of a third exemplary lock cylinder.
Figure 7:
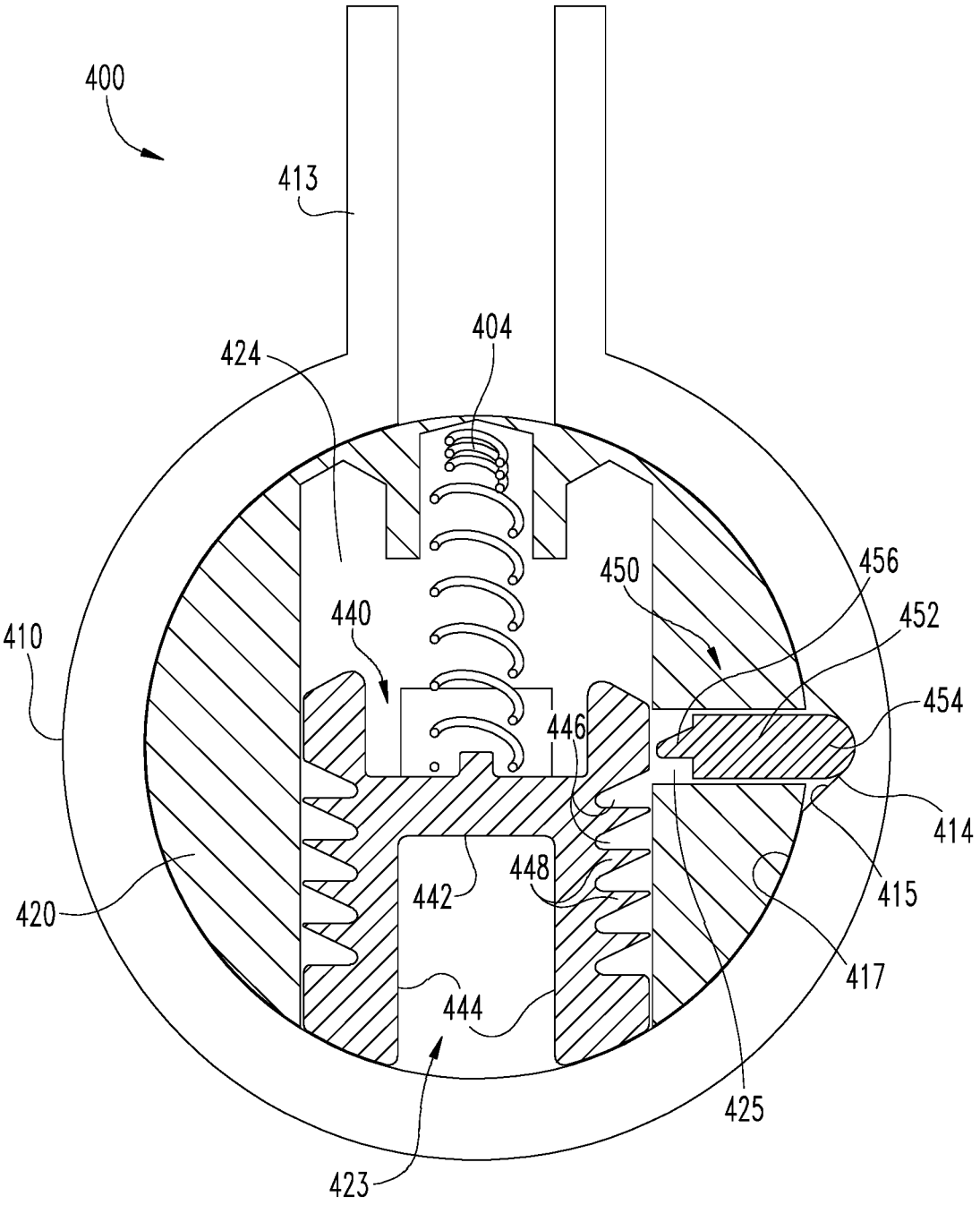
FIG. 7 is a transverse cross-sectional illustration of the third exemplary lock cylinder.

With reference to FIGS. 6 and 7, a third illustrative lock cylinder 400 includes a shell 410, a plug 420 disposed within the shell 410, and a locking assembly operable in a blocking state and an unblocking state, depicted herein as including at least one rack pin 440 and a sidebar 450. In the illustrated embodiment, the locking assembly includes two of the rack pins 440, although it is also contemplated that more or fewer rack pins 440 may be utilized.

The shell 410 includes a substantially cylindrical chamber 412, and a groove 414 defined by tapered surfaces or cam surfaces 415 extending radially outward from an inner surface 417 of the shell 410. The groove 414 and cam surfaces 415 may be configured in a manner similar to the previously-described channel 314 and cam surface 315. The plug 420 is positioned in the chamber 412, and includes a keyway 423, a pin cavity 424 for each of the rack pins 440, and a pocket 425 for receiving the sidebar 450. The keyway 423 is defined in part by a ward 426, and may be formed in a conventional manner known in the industry, for example by milling or machining the plug 420. The pin cavities 424 and pocket 425 may likewise be created by milling or machining the plug 420. For example, the pin cavities 424 may be formed by removing material from the bottom portion of the plug 420, while retaining a portion of the material at the top of the plug 420.

Each rack pin 440 is positioned in one of the pin cavities 424 along with a spring or biasing member 404 which urges the rack pin 440 toward the keyway 423. Each of the rack pins 440 includes a top leg 442 and a pair of side legs 444. In the illustrated embodiment, the top leg 442 is perpendicular to the side legs 444, although other configurations are contemplated. For example, in certain embodiments, the legs 442, 444 may be substantially perpendicular, or may be offset by an oblique angle. In the illustrated form, the side legs 444 extend from the top leg 442 in both vertical directions, giving the rack pin 440 a substantially H-shaped cross-section. It is also contemplated that the side legs 444 may extend from the top leg 442 in only a single direction, such that the rack pin 440 comprises a substantially U-shaped cross-section. The rack pins 440 may be created using any method known in the art, such as, for example, injection molding, machining, or die casting.

The top leg 442 is positioned at least partially in the keyway 423, and is configured to travel along the top cut of a key during key insertion and extraction. The top leg 442 may include a tapered bottom surface (for example, angled or curved) to facilitate such travel. When the key is inserted into the keyway 423, the rack pins 440 move in a direction substantially perpendicular to the direction of key insertion as the top legs 442 travel along the bittings. If the rack pin 440 is blocked from moving in the necessary direction, interference between the top legs 442 and the key bittings prevent the key from being inserted or extracted.

At least one of the side legs 444 includes a plurality of notches 446 defined in part by ridges 448. In the illustrated embodiment, each of the side legs 444 includes the notches 446, such that the rack pin 440 is substantially symmetrical. As such, the rack pin 440 can be inserted into the pin cavity 424 in either direction during assembly of the cylinder 400. It is also contemplated that only one of the side legs 444 may include the notches 446, in which the rack pin 440 is inserted into the pin cavity 424 with the notched side leg 444 adjacent to the pocket 425.

The sidebar 450 is seated in the pocket 425, and is biased radially outward by springs or biasing members 405. The illustrated sidebar 450 extends in the axial direction of the plug 420, is aligned with each of the rack pins 440, and includes a body portion 452, a tapered portion 454 on the radially outer side of the body portion 452, and a protrusion 456 on the radially inner side of the body portion 452. While the length of the sidebar 450 is less than that of the plug 420, it is also contemplated that the sidebar 450 may extend substantially the entire length of the plug 420, or that the sidebar 450 may be replaced by one or more pins having a similar cross-section. As best seen in FIG. 7, the height of the body portion 452 corresponds to that of the pocket 425 to prevent rocking or pivoting of the sidebar 450 during operation.

The tapered portion 454 comprises a cam surface, and may have a geometry corresponding to that of the groove 414. The cam surfaces of the tapered portion 454 and the groove 414 are configured such that, when a torque is applied to the plug 420, the sidebar 450 is urged radially inward toward the rack pin 440 as the tapered portion 454 travels along the cam surface 415 and into contact with the shell inner surface 417. While the cam surfaces of the illustrated groove 414 and tapered portion 454 comprise a curvilinear profile, it is also contemplated that one or more of the cam surfaces may comprise a rectilinear profile.

The protrusion 456 has a shape corresponding to that of the notches 446, such that when the protrusion 456 is aligned with one of the notches 446 and the plug 420 is rotated, the protrusion 456 is received by one of the notches 446 as the sidebar 450 travels radially inward. Due to the fact that the biasing member 404 urges the top leg 442 into contact with the key, the position of the rack pin 440 corresponds to the root depth of the key at the point of contact. Accordingly, the notches 446 may be spaced and configured such that when the rack pin 440 is in a position corresponding to one of the possible root depths, one of the notches 446 is aligned with the protrusion 456. The number and spacing of the notches 446 may vary according to the set of possible root depths for the key family associated with the cylinder 400.

When the plug 420 is in the home position and no key is inserted, the locking assembly is in a blocking state wherein rotation of the plug 420 is prevented. In the blocking state, the protrusion 456 is aligned with a portion of the side leg 444 that does not include a notch 446. If a torque is applied in an attempt to rotate the plug 420, the sidebar 450 is urged radially inward as described above. Because the protrusion 456 is not aligned with a notch 446, however, the rack pin 440 blocks the path of the sidebar 450, preventing radially-inward motion. The sidebar 450 therefore cannot travel radially inward to a position in which it does not cross the shear line 402, and rotation of the plug 420 is prevented due to interference between the cam surface 415 and the tapered portion 454.

When a proper key is inserted, the rack pins 440 are urged upward against the biasing force of the springs 404 to a position in which one of the notches 446 is aligned with the protrusion 456. When the protrusion 456 is aligned with a notch 446 of each rack pin 440, the locking assembly is in an unblocking state wherein rotation of the plug 420 is permitted. In the unblocking state, rotation of the plug 420 urges the sidebar 450 radially inward, such that the protrusion 456 is received in a notch 446 of each rack pin 440.

When the plug 420 is in the rotated position, the tapered portion 454 is in contact with the shell inner surface 417, preventing the sidebar 450 from moving radially outward. As such, the protrusion 456 cannot exit the notches 446 in which it is positioned. If the user attempts to extract the key when the plug 420 is in the rotated position, interference between the protrusion 456 and the ridges 448 prevents the rack pin 440 from moving within the pin cavity 424, and interference between the top leg 442 and the key bittings prevent the key from being extracted.

As the plug 420 is rotated back to the home position, the biasing members 405 urge the sidebar 450 radially outward into the groove 414, moving the protrusion 456 out of alignment with the ridges 448. The rack pins 440 again become free to travel, permitting extraction of the key. Once the key is extracted, the biasing members 404 urge the rack pins 440 to their initial positions, wherein the protrusion 456 is not aligned with any of the notches 446, and the locking assembly is in the blocking state.

Figure 8:
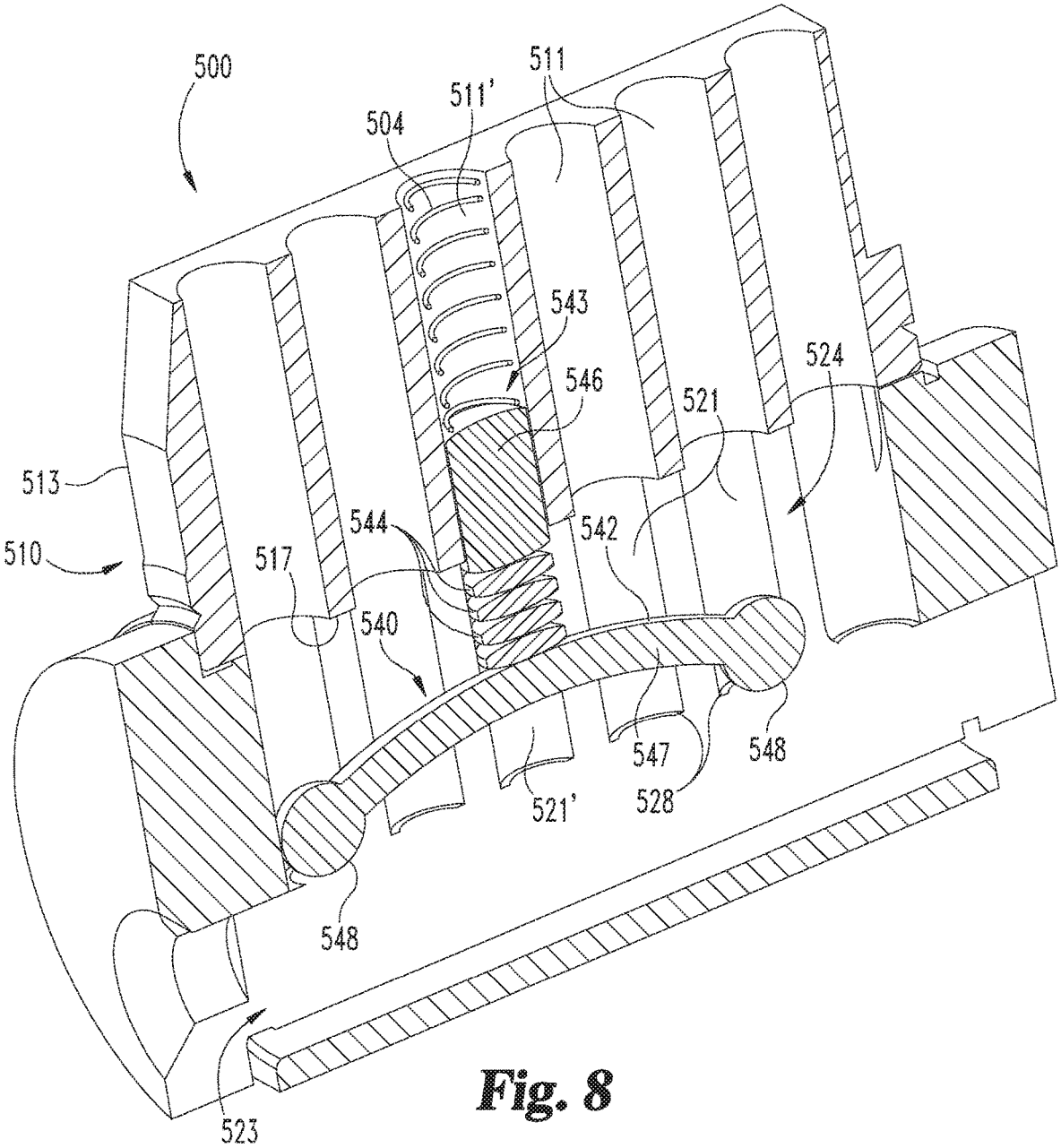
FIG. 8 is a longitudinal cross-sectional illustration of a fourth exemplary lock cylinder.
Figure 9:
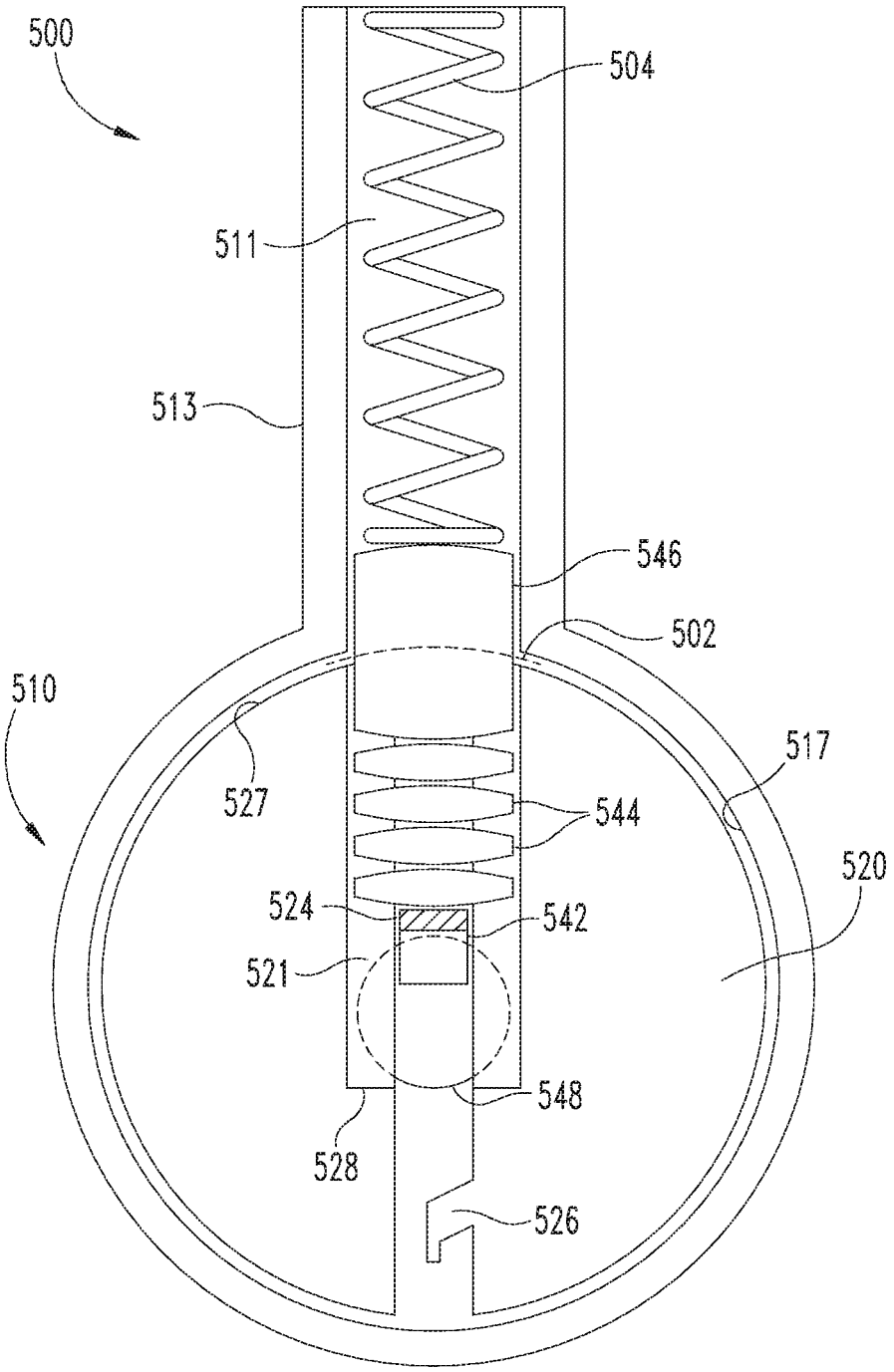
FIG. 9 is a transverse cross-sectional illustration of the fourth exemplary lock cylinder.

With reference to FIGS. 8 and 9, a fourth exemplary lock cylinder 500 includes a shell 510, a plug 520 disposed within the shell 510, and a locking assembly operable in a blocking state and an unblocking state, depicted herein as a rocker assembly 540. The illustrative shell 510 is a conventional key-in-lever type shell, and includes a plurality of shell tumbler cavities 511 formed in a tower 513. The plug 520 includes a plurality of plug tumbler cavities 521, which, when the plug 520 is in a home position, align with the shell tumbler cavities 511. In the illustrated form, the plug 520 is a conventional plug which has been retrofitted to include a pocket 524 connecting at least some of the plug tumbler cavities 521. It is also contemplated that the plug 520 may be custom-made, in which case the plug 520 may include fewer plug tumbler cavities 521.

The rocker assembly 540 includes a rocker arm 542 and a pin stack 543 including a plurality of master pins 544 and a driving pin 546. The rocker assembly 540 may further include a biasing member or spring 504 to bias the pin stack 543 toward the keyway 523. The rocker arm 542 includes an arcuate member 547 positioned within the pocket 524, and enlarged end portions 548, each of which is positioned in one of the plug tumbler cavities 521. While other geometries are contemplated, in the illustrated embodiment, the arcuate member 547 comprises a rectangular cross-section, and the end portions 548 are round or spherical to facilitate travel along the top cut of a key during key insertion and extraction. The rocker arm 542 may be created using any method known in the art, such as, for example, plastic or metal injection molding, machining, or die casting.

During assembly of the cylinder 500, the rocker arm 542 is placed in the plug 520 such that the arcuate member 547 is positioned in the pocket 524, and each of the end portions 548 is positioned in one of the plug tumbler cavities 521. The end portions 548 are permitted to drop to the bottom of the plug tumbler cavities 521, where they are retained by ledges 528. The end portions 548 may comprise a diameter corresponding to that of a bottom pin in a conventional lock cylinder, for example if the plug 520 is created by retrofitting an existing plug. In the illustrated embodiment, the end portions 548 are installed in the first and fifth plug tumbler cavities 521; it is also contemplated that the end portions 548 may be positioned in other plug tumbler cavities 521.

After the rocker arm 542 has been installed in the plug 520, the plug 520 is inserted into the shell 510, and a C-clip or end cap (not illustrated) may be installed to prevent axial movement of the plug 520 within the chamber 512. The pin stack 543 and spring 504 may then be inserted into one of the shell tumbler cavities 511'. While the spring 504 and pin stack 543 are depicted as having been inserted into the third shell tumbler cavity 511, it is also contemplated that the spring 504 and pin stack 543 may be inserted into another of the shell tumbler cavities 511. When the plug tumbler cavities 521 become aligned with the shell tumbler cavities 511, the master pins 544 and a portion of the driving pin 546 move into the plug tumbler cavity 521' which is aligned with the shell tumbler cavity 511'. To complete assembly of the cylinder 500, a top cover (not illustrated) may then be attached to the shell 510 to prevent the spring 504 and pin stack 543 from escaping the shell tumbler cavity 511'.

During operation, when the plug 520 is in the home position and no key is inserted, the pin stack 543 is positioned partially in the shell tumbler cavity 511' and partially in the plug tumbler cavity 521'. Each of the master pins 544 is positioned in the plug tumbler cavity 521', and the driving pin 546 is positioned partially in the plug tumbler cavity 521' and partially in the shell tumbler cavity 511'. This defines a blocking state of the rocker assembly 540, wherein the driving pin 546 crosses a shear line 502 of the cylinder 500, preventing rotation of the plug 520 with respect to the shell 510.

When a key is inserted, the key contacts the end portions 548, urging the rocker arm 542 toward the tower 513 as the end portions 548 travel along the top cut of the key. As a result, the end portions 548 move within the plug tumbler cavities 521, and the arcuate member 547 moves within the pocket 524. As the rocker arm 542 moves, the pin stack 543 is urged upward against the force of the spring 504 to a position in which at least the driving pin 546 is positioned entirely within the shell tumbler cavity 511'; depending upon the root depth of the key at the points of contact with the end portions 548, one or more of the master pins 544 may also be positioned within the shell tumbler cavity 511'. Because the driving pin 546 no longer crosses the shear line 502, the rocker assembly 540 is in an unblocking state wherein the plug 520 is free to rotate with respect to the shell 510.

As the plug 520 is rotated from the home position to the rotated position, the driving pin 546 and possibly one or more of the master pins 544 are retained within the shell tumbler cavity 511' by an outer surface 527 of the plug 520. If less than all of the master pins 544 are positioned in the shell tumbler cavity 511', the remaining master pins 544 are retained within the plug tumbler cavity 521' by the shell inner surface 517. If the user attempts to extract the key while the plug 540 is in the rotated position, the key bittings urge the end portions 548 radially outward. This outward force is countered by a radially inward force from the shell inner surface 517, which prevents the rocker arm 542 from traveling radially outward, either through direct engagement with the arcuate member 547 or through one or more of the master pins 544. Because the rocker arm 542 cannot travel radially outward, key extraction is prevented by interference between the end portions 548 and the key bittings. When the plug 540 is returned to the home position, the rocker assembly 540 again becomes free to travel, and key extraction is once again enabled.

In order to ensure that the master pins 544 to not prevent rotation of the plug 520 when the key is inserted, the exemplary master pins 544 include curved or beveled surfaces. When one of the master pins 544 crosses the shear line 502, rotation of the plug 520 causes the shell 510 or the plug 520 to contact the beveled surface, thereby urging the master pin 544 toward either the shell tumbler cavity 511' or the plug tumbler cavity 521'. For example, the plug outer surface 527 may urge the master pin 544 into the shell tumbler cavity 511', or the shell inner surface 517 may urge the master pin 544 into the plug tumbler cavity 521'. The arcuate member 547 may be slightly flexible, such that it elastically deforms when the latter occurs.

The rocker assembly 540 provides both an unlocking functionality and a key retention functionality, regardless of the bitting profile of the key. The unlocking functionality enables the rocker assembly 540 to transition from the blocking state to the unblocking state upon insertion of a key, and the key retention functionality enables the lock cylinder 500 to prevent key extraction when the plug 520 is in the rotated position. These functionalities may be provided, for example, by appropriate selection of the length of the master pins 544 and the driving pin 546, the number of master pins 546, and the curvature and/or rigidity of the arcuate member 547. For example, in the illustrated embodiment, the rocker arm 542 and pin stack 543 are configured such that the driving pin 546 crosses the shear line 502 when no key is inserted. The rocker arm 542 and pin stack 543 are further configured to move the driving pin 546 into the shell tumbler cavity 511' when the end portions 548 are supported by portions of the key having the minimum possible root depth. The rocker assembly 540 therefore provides the unlocking functionality regardless of the bitting profile of the key.

As stated above, the rocker assembly 540 is further configured to prevent key extraction when the plug 520 is in the rotated position, regardless of the bitting profile of the key. In order to provide this functionality, the rocker arm 542 may be configured such that the arcuate member 547 comes into contact with the shell inner surface 517 when the end portions 548 are supported by portions of the key having the maximum possible root depth. Alternatively, one or more of the master pins 544 may remain within the plug tumbler cavity 521' when the end portions 548 are supported by portions of the key having the maximum possible root depth. In either case, the rigidity of the arcuate member 547 may be selected such that, when the user attempts to extract the key while the plug 520 is in the rotated position, the arcuate member 547 prevents the end portions 548 from traveling radially outward by an amount sufficient to permit key extraction.

Figure 10:
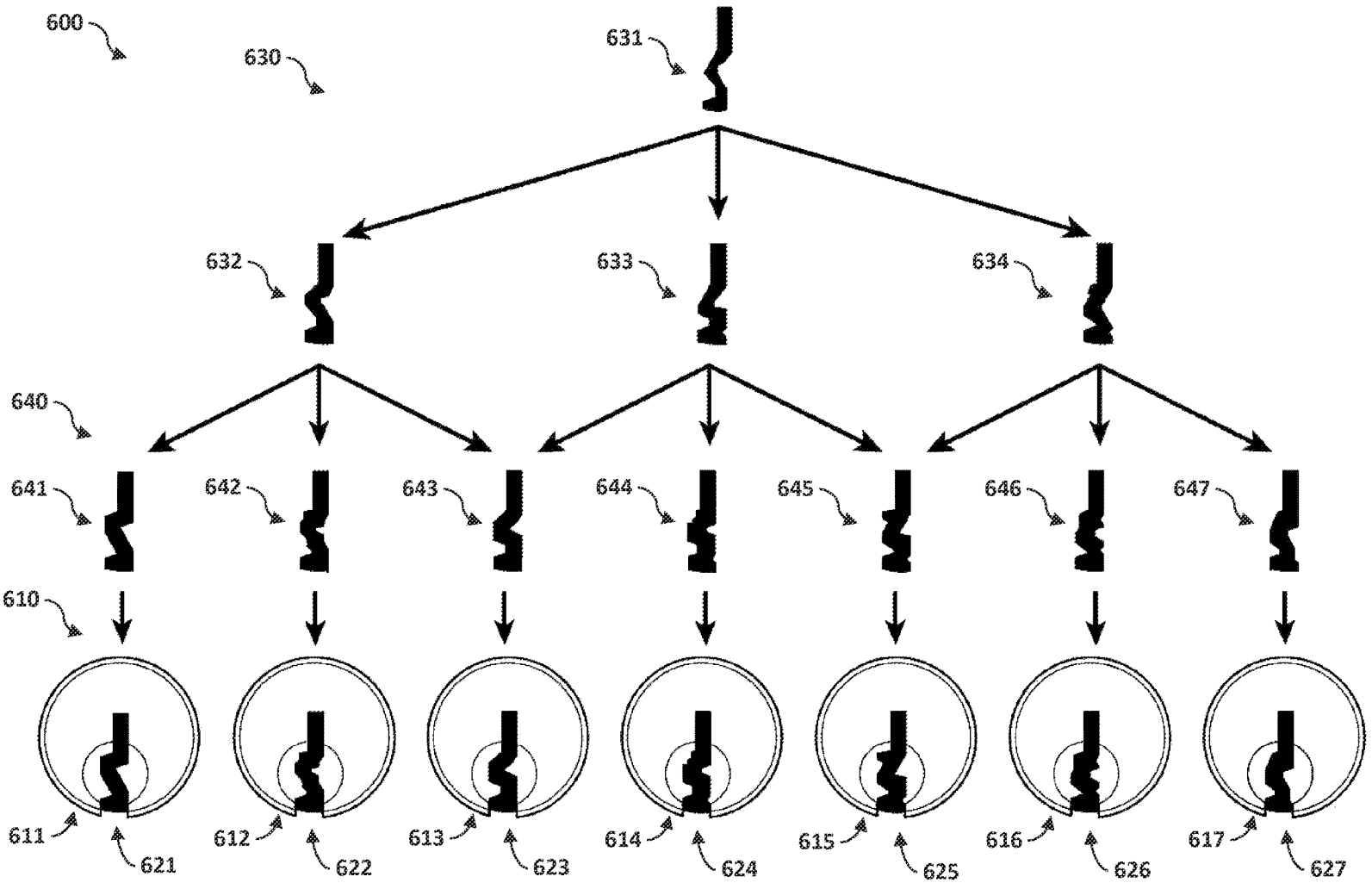
FIG. 10 is a schematic depiction of an illustrative keying system.

FIG. 10 depicts an example keying system 600, which comprises a plug set 610 including a plurality of plugs 611-617 with illustrative keyways 621-627, and a key profile set 630 including a plurality of key profiles 631-634 and 641-647. The plugs 611-617 may, for example, be utilized in conjunction with one of the previously-described lock cylinders, such that the keyways of those plugs are similar to one of the depicted keyways 621-627. The key profile set 630 comprises a plurality of unique cross-sectional profiles, including a grandmaster profile 631, a plurality of master profiles 632-634, and a standard profile set 640 including a plurality of standard profiles 641-647.

The keyways 621-627 are configured to permit entry of a key having an appropriate cross-sectional profile, and to prevent an inappropriately-shaped key from being inserted into the plugs 611-617. Each of the cross-sectional profiles in the profile set 630 is configured to permit a key having the profile to be inserted into at least one member of the plug set 610, and may be configured to permit the key to be inserted into multiple members of the plug set 610. For example, keys comprising the grandmaster profile 631 can be inserted into any plug in the plug set 610. Keys comprising one of the master profiles 632-634 can be inserted into only a subset of the plug set 610; for example, a key comprising the master profile 632 can be inserted into a subset including the plugs 611-613, but cannot be inserted into the remaining plugs 614-617. Keys comprising one of the standard profiles 641-647 can be inserted into only one of plugs in the plug set 610; for example a key comprising the standard profile 641 can be inserted into one of the plugs 611, but not the remaining plugs 612-617. Similarly, the keyways 621-627 may be configured to accept keys comprising different cross-sectional profiles selected from the cross-sectional profile set 630. For example, while the keyway 623 can accept a key comprising either of the master key profiles 632, 633, the keyway 624 can accept a key comprising the master key profile 633, but not one comprising the master key profile 632.

With additional reference to FIG. 1, when the keying system 600 is utilized in an access control system such as the system 100, each member of the key family 120 may comprise a cross-sectional profile selected from the key profile set 630. In certain embodiments, each member of the key family 120 may comprise the same cross-sectional profile. It is also contemplated that a first subset of the key family 120 may a first cross-sectional profile selected from the profile set 630, and a second subset of the key family 120 may comprise a second cross-sectional profile selected from the profile set 630.

Furthermore, the keyway of the inner cylinder 113 may be the same as the keyway of the outer cylinder 114, or may be of a different configuration. For example, the inner cylinder 113 may include the plug 613, and the outer cylinder 114 may include the plug 614. In such a case, one key 122 may comprise the cross-sectional profile 632, and another key 123 may comprise the cross-sectional profile 633. As a result, the key 122 can be inserted into the inner cylinder 113 but not the outer cylinder 114, while the key 123 can be inserted into either of the cylinders 113, 114. Thus, while either of the keys 122, 123 can operate the inner cylinder 113, only the key 123 can be used to operate the outer cylinder 114, even in a case where the keys 122, 123 comprise the same bitting profile. This enables a greater number of keys to lock the door 101 from the interior of the room 102, while retaining the security of the exterior cylinder 114.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock cylinder, comprising:

a shell defining a generally cylindrical chamber having an inner surface and a longitudinal groove at least partially defined by a tapered surface extending radially outward from the inner surface;

a plug rotatably mounted in the chamber for rotation between a home position and a rotated position, the plug defining:

a longitudinally-extending keyway;

at least one pin cavity connected with the keyway; and a longitudinal pocket in communication with the pin cavity, wherein the longitudinal pocket is aligned with the longitudinal groove when the plug is in the home position;

a sidebar movably mounted in the pocket for movement between a radially inward position and a radially outward position, wherein the tapered surface of the shell is configured to urge the sidebar toward the radially inward position as the plug rotates from the home position to the rotated position, and wherein rotation of the plug from the home position is blocked when the sidebar is prevented from moving to the radially inward position; and at least one pin seated in a corresponding one of the at least one pin cavity, each pin comprising a first leg facing the keyway and a second leg facing the longitudinal pocket, wherein each second leg comprises a plurality of notches, wherein each notch is configured to permit radially inward movement of the sidebar when aligned with the sidebar, each pin having a blocking position in which no notch of the pin is aligned with the sidebar and the pin blocks movement of the sidebar from the radially outward position, each pin having a plurality of unblocking positions in which a corresponding one of the notches is aligned with the sidebar and the pin does not prevent radially inward movement of the sidebar;

wherein the plurality of notches for each pin comprises five notches such that each pin has five unblocking positions.

2. The lock cylinder of claim 1, further comprising:

a first spring urging the pin toward the blocking position; and a second spring urging the sidebar toward the radially outward position.

3. The lock cylinder of claim 1, wherein the at least one pin cavity comprises a plurality of the pin cavity, and wherein the at least one pin comprises a plurality of the pin.

4. The lock cylinder of claim 1, wherein each pin further comprises a third leg extending from the first leg and arranged parallel to the second leg such that the second leg and the third leg are positioned on opposite sides of the keyway.

5. The lock cylinder of claim 4, wherein each third leg comprises a second plurality of notches corresponding to the plurality of notches defined by the second leg.

6. The lock cylinder of claim 1, wherein the second leg of each pin extends from the first leg of the pin in a first direction transverse to the keyway and a second direction opposite the first direction.

7. The lock cylinder of claim 6, wherein a first portion of the second leg of each pin extends from the first leg of the pin in the first direction, wherein a second portion of the second leg of each pin extends from the first leg of the pin in the second direction, and wherein no notches of the pin are formed in the first portion of the second leg.

8. A system comprising the lock cylinder of claim 1, the system further comprising a plurality of keys configured for insertion into the keyway, each key having a different bitting profile; and wherein each key, when inserted into the keyway, moves each pin from the blocking position to a corresponding one of the unblocking positions.

9. The system of claim 8, wherein each key comprises at least one bitting configured to engage the at least one pin upon full insertion of the key into the keyway;

wherein each key has a different root depth at the at least one bitting;

wherein each root depth is selected from a set of possible root depths; and wherein each notch corresponds to a respective one of the possible root depths such that each key is operable to move the at least one pin from the blocking position to an unblocking position corresponding to the root depth of the key at the at least one bitting.

10. A locking assembly comprising the lock cylinder of claim 1, wherein the lock cylinder is mounted to a first side of a door;

the locking assembly further comprising a second lock cylinder mounted to a second side of the door, the second lock cylinder comprising a second shell and a second plug selectively rotatable relative to the second shell;

wherein the locking assembly has a locked state and an unlocked state; and wherein each plug is configured to transition the locking assembly between the locked state and the unlocked state upon rotation of the plug.

11. The locking assembly of claim 10, further comprising a bolt operably connected with each of the first plug and the second plug, the bolt having an extended position in the locked state, the bolt having a retracted position in the unlocked state.

12. A system comprising the locking assembly of claim 10, the system further comprising a plurality of keys configured for insertion into the keyway, each key having a different bitting profile;

wherein each key is operable to rotate the plug of the lock cylinder;

wherein a first key of the plurality of keys is operable to rotate the second plug; and wherein a second key of the plurality of keys is inoperable to rotate the second plug.

13. The lock cylinder of claim 1, wherein each notch comprises a lower surface that is perpendicular to the keyway and an upper surface that is oblique relative to the keyway.

14. A lock cylinder, comprising:

a shell defining a generally cylindrical chamber having an inner surface and a longitudinal groove at least partially defined by a tapered surface extending radially outward from the inner surface;

a plug rotatably mounted in the chamber for rotation between a home position and a rotated position, the plug defining:

a longitudinally-extending keyway;

at least one pin cavity connected with the keyway; and a longitudinal pocket in communication with the pin cavity, wherein the longitudinal pocket is aligned with the longitudinal groove when the plug is in the home position;

a sidebar movably mounted in the pocket for movement between a radially inward position and a radially outward position, wherein the tapered surface of the shell is configured to urge the sidebar toward the radially inward position as the plug rotates from the home position to the rotated position, and wherein rotation of the plug from the home position is blocked when the sidebar is prevented from moving to the radially inward position; and at least one pin seated in a corresponding one of the at least one pin cavity, each pin comprising a first leg facing the keyway and a second leg facing the longitudinal pocket, wherein each second leg comprises a plurality of notches, wherein each notch is configured to permit radially inward movement of the sidebar when aligned with the sidebar, each pin having a blocking position in which no notch of the pin is aligned with the sidebar and the pin blocks movement of the sidebar from the radially outward position, each pin having a plurality of unblocking positions in which a corresponding one of the notches is aligned with the sidebar and the pin does not prevent radially inward movement of the sidebar;

wherein the second leg of each pin extends from the first leg of the pin in a first direction transverse to the keyway and a second direction opposite the first direction; and wherein each pin is symmetrical relative to the keyway and has an H-shaped cross-section.

15. A system, comprising a lock cylinder, comprising:

a shell;

a plug rotatably mounted in the shell for rotation between a home position and a rotated position, the plug defining a keyway;

a sidebar movably mounted to the plug and configured for movement between a radially outward position and a radially inward position, wherein rotation of the plug from the home position is prevented when the sidebar is maintained in the radially outward position; and a pin having a blocking position and a plurality of unblocking positions, the pin comprising a plurality of notches;

wherein, with the pin in the blocking position, none of the notches are aligned with the sidebar and the pin maintains the sidebar in its radially outward position, thereby preventing rotation of the plug relative to the shell; and wherein, with the pin in each of the unblocking positions, a corresponding one of the notches is aligned with the sidebar such that the pin does not prevent movement of the sidebar to its radially inward position; and a family of keys comprising a plurality of keys, each key of the key family configured for insertion into the keyway and comprising a bitting profile including a first bitting that engages the pin upon insertion of the key into the keyway, wherein each key has a different root depth at the first bitting such that each key places the pin in a different one of the unblocking positions upon insertion of the key into the keyway;

wherein the plurality of notches comprises five of the notches such that the plurality of unblocking positions comprises five of the unblocking positions.

16. The system of claim 15, wherein the pin comprises a first leg configured to engage the first bitting of each key and a second leg including a first portion extending from the first leg in a first direction, the first portion of the second leg defining the notches.

17. The system of claim 16, wherein the second leg further includes a second portion extending from the first leg in a second direction opposite the first direction, and wherein the second portion lacks a notch such that alignment of the second portion with the sidebar defines the blocking position.

18. The system of claim 16, wherein the pin further comprises a third leg extending from the first leg in the first direction such that the second leg and the third leg are positioned on opposite sides of the keyway.

19. The system of claim 18, wherein the third leg further comprises a second plurality of notches corresponding to the plurality of notches defined by the second leg.

20. The system of claim 15, wherein the pin has a single blocking position, and wherein insertion of each and any key of the plurality of keys moves the pin from the single blocking position to a corresponding one of the unblocking positions.

* * * * *